US010562693B1

(12) United States Patent
Ambrezewicz

(10) Patent No.: US 10,562,693 B1
(45) Date of Patent: Feb. 18, 2020

(54) MULTIPLE CONDIMENT CONTAINER ASSEMBLY

(71) Applicant: Lucas Ambrezewicz, Bothell, WA (US)

(72) Inventor: Lucas Ambrezewicz, Bothell, WA (US)

( * ) Notice: Subject to any disclaimer, the term of this patent is extended or adjusted under 35 U.S.C. 154(b) by 0 days.

(21) Appl. No.: 16/275,002

(22) Filed: Feb. 13, 2019

(51) Int. Cl.
*B65D 1/04* (2006.01)
*B65D 81/32* (2006.01)
*B65D 47/08* (2006.01)
*A47G 19/24* (2006.01)

(52) U.S. Cl.
CPC ..... *B65D 81/3283* (2013.01); *B65D 47/0838* (2013.01); *A47G 19/24* (2013.01); *B65D 1/04* (2013.01)

(58) Field of Classification Search
CPC .. B65D 81/3283; B65D 47/0838; B65D 1/04; A47G 19/24
See application file for complete search history.

(56) References Cited

U.S. PATENT DOCUMENTS 1,322,752 A * 11/1919 Belefant ..... A47G 19/24 222/142.1
2,130,275 A * 9/1938 Heebner ..... A47G 19/24 222/142.6
2,731,013 A * 1/1956 Holmes ..... B65D 81/3283 604/416
2,747,388 A * 5/1956 Dolar ..... A47J 47/02 220/524
2,890,816 A * 6/1959 Horland ..... A47G 19/24 222/142.3
3,187,964 A * 6/1965 Foster ..... B65D 47/0833 222/480
3,547,303 A * 12/1970 Mascia ..... B65D 25/04 220/524
3,876,112 A 4/1975 Kramer
4,488,667 A * 12/1984 Swett ..... A47G 19/24 222/485
4,658,980 A * 4/1987 Lindstrom ..... B65D 55/024 220/214
4,804,113 A * 2/1989 Ciaccio ..... B65D 47/0833 220/254.2
5,158,191 A 10/1992 Douglas
5,303,841 A * 4/1994 Mezey ..... B65F 1/004 220/555

(Continued)

*Primary Examiner* — David P Angwin
*Assistant Examiner* — Bob Zadeh

(57) ABSTRACT

A multiple condiment container assembly includes a container and dividers positioned to define chambers within the container. Each of the chambers can contain a respective condiment. A lid is removably coupled to the container and has a plurality of openings. Each opening is aligned with a respective chamber when the lid is coupled to the container. Each of a plurality of first panels is hingedly coupled to the lid and aligned with a respective one of the openings in the lid and each of the first panels has an aperture extending therethrough. The aperture in each of the first panels is in fluid communication with the respective opening in the lid to dispense the condiment contained in the chamber into which the respective opening extends. A plurality of second panels is each hingedly coupled to a respective one of the first panels closing the aperture in the respective first panel.

8 Claims, 6 Drawing Sheets

(56) References Cited

U.S. PATENT DOCUMENTS

| | | | | |
|---|---|---|---|---|
| 5,762,199 | A * | 6/1998 | Aguilera | B65D 83/0454 206/533 |
| D414,104 | S | 9/1999 | Klauke | |
| 6,341,716 | B1 * | 1/2002 | Goettner | B65D 47/305 222/129 |
| 6,732,888 | B1 | 5/2004 | Smiley | |
| D517,866 | S | 3/2006 | Burks | |
| 7,258,251 | B2 | 8/2007 | Johnson | |
| 2005/0029280 | A1 * | 2/2005 | Hayes | B65D 1/04 221/34 |
| 2006/0060618 | A1 * | 3/2006 | Hoepner | B65D 47/089 222/565 |
| 2009/0127263 | A1 * | 5/2009 | Hylton | A47G 19/2272 220/507 |
| 2009/0188929 | A1 * | 7/2009 | Sims | A47G 19/2205 220/710 |
| 2009/0218357 | A1 * | 9/2009 | Byrd | A47G 19/2272 220/592.2 |
| 2012/0299629 | A1 | 11/2012 | Ogasahara | |
| 2015/0102041 | A1 * | 4/2015 | Lee | A47G 19/30 220/575 |
| 2015/0158632 | A1 * | 6/2015 | Wilhelm | B65D 25/04 426/120 |
| 2015/0274399 | A1 * | 10/2015 | Carse | B65D 81/3283 206/221 |
| 2016/0114942 | A1 * | 4/2016 | Mussio | B65D 43/0222 222/144.5 |

* cited by examiner

MULTIPLE CONDIMENT CONTAINER ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to condiment devices and more particularly pertains to a new condiment device for individually storing and dispensing a plurality of condiments.

BRIEF SUMMARY OF THE INVENTION

An embodiment of the disclosure meets the needs presented above by generally comprising a container and a plurality of dividers positioned within the container to define a plurality of chambers within the container. Thus, each of the chambers can contain a respective one of a plurality of condiments. A lid is removably coupled to the container and the lid has a plurality of openings extending therethrough. Each of the openings is aligned with a respective one of the chambers when the lid is removably coupled to the container. A plurality of first panels is each hingedly coupled to the lid. Each of the first panels is aligned with a respective one of the openings in the lid and each of the first panels has an aperture extending therethrough. The aperture in each of the first panels is in fluid communication with the respective opening in the lid to dispense the condiment contained in the chamber into which the respective opening extends. A plurality of second panels is each hingedly coupled to a respective one of the first panels closing the aperture in the respective first panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
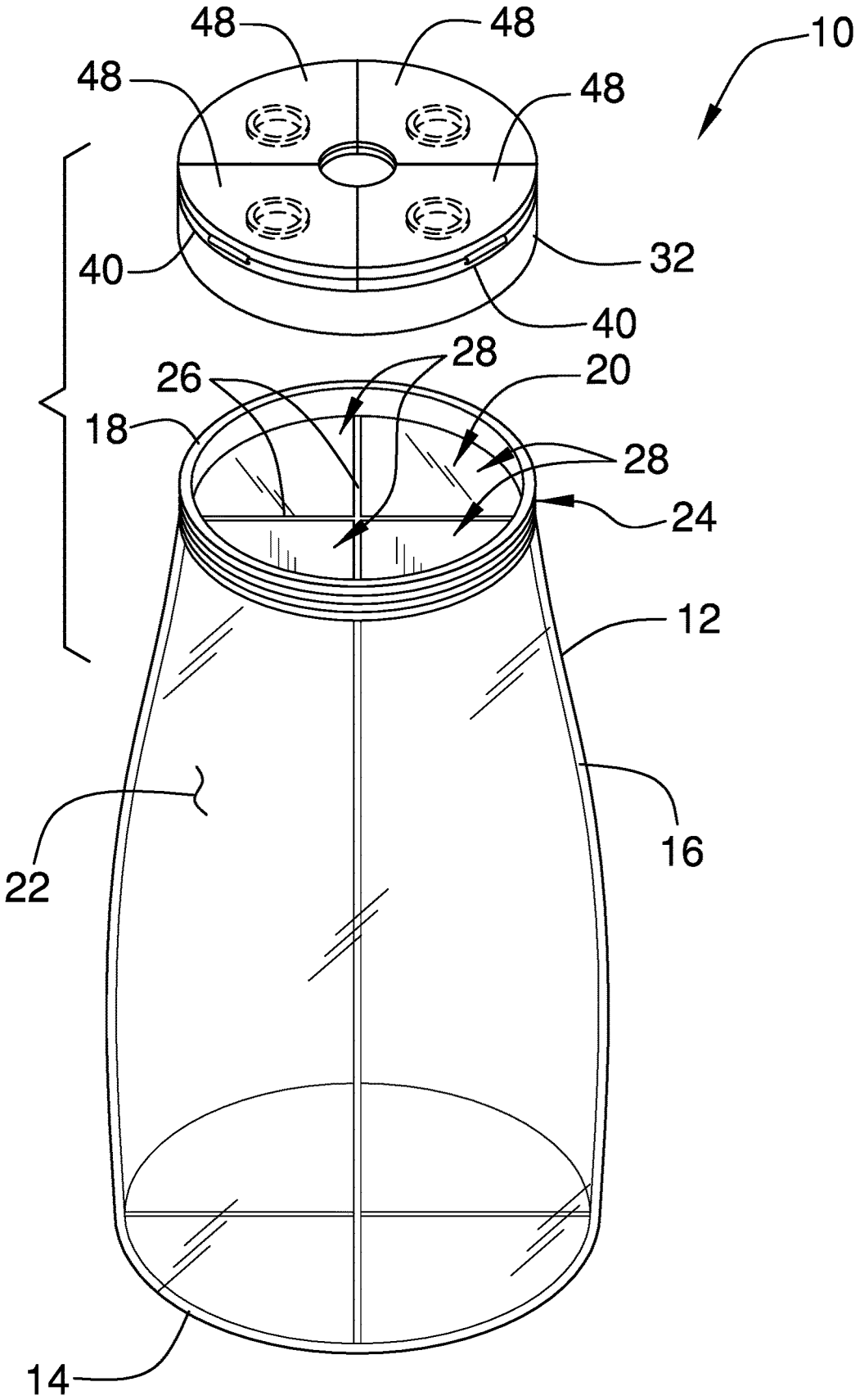
FIG. 1 is an exploded perspective view of a multiple condiment container assembly according to an embodiment of the disclosure.
Figure 2:
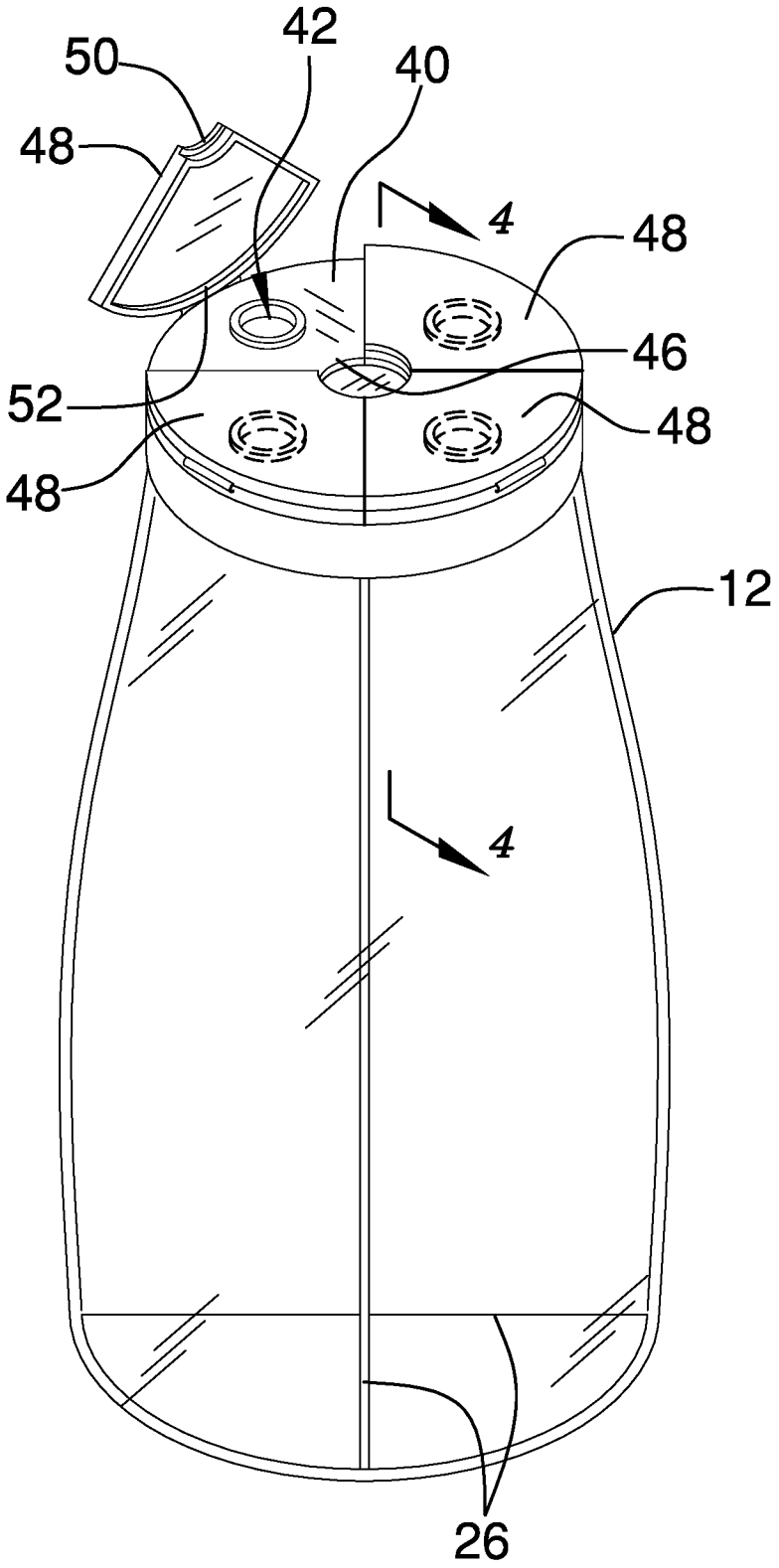
FIG. 2 is a top perspective view of an embodiment of the disclosure showing a second panel being positioned in an open position.
Figure 3:
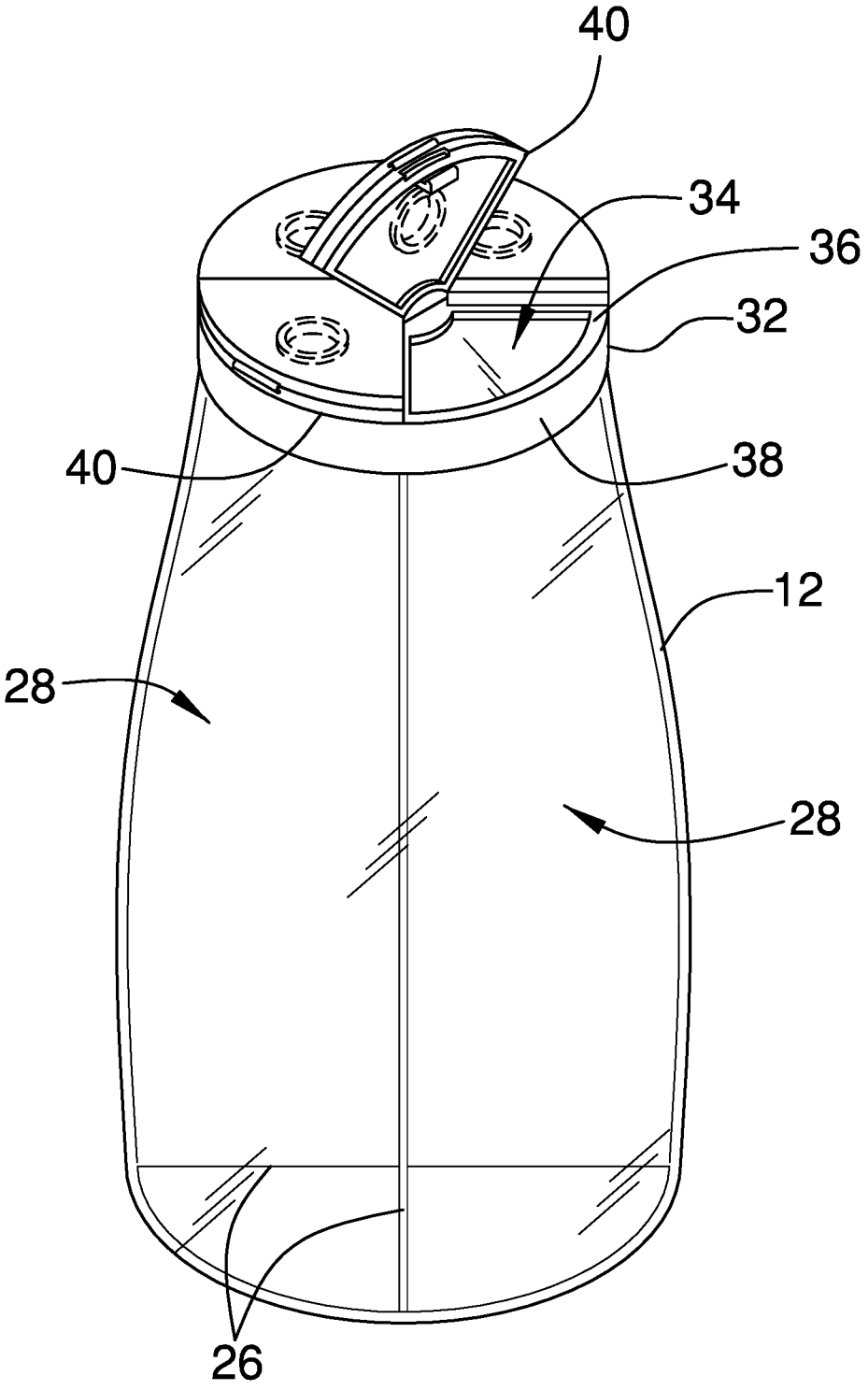
FIG. 3 is a top perspective view of an embodiment of the disclosure showing a first panel being positioned in an open position.
Figure 4:
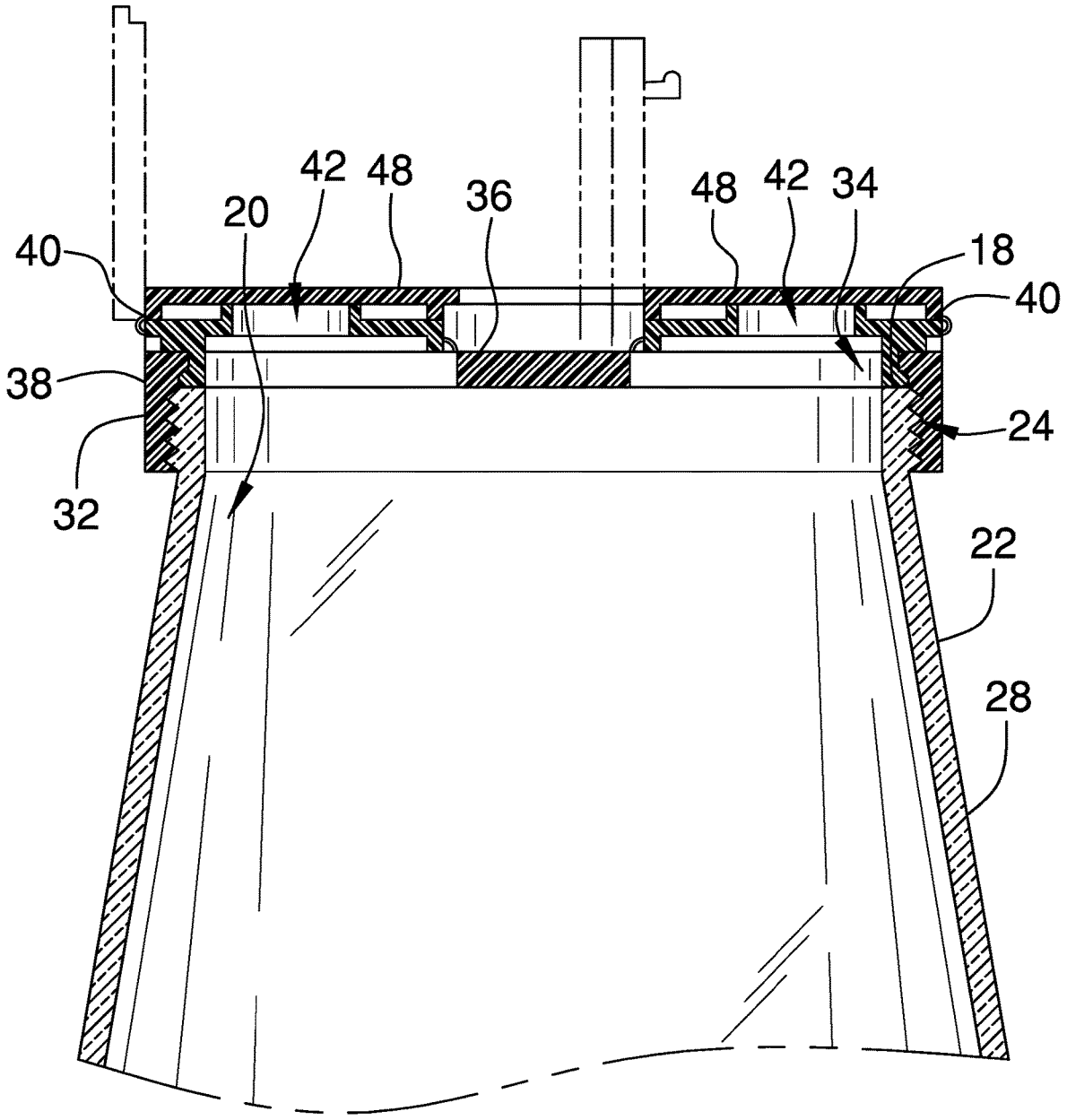
FIG. 4 is a cross sectional view taken along line 4-4 of FIG. 2 of an embodiment of the disclosure.

With reference now to the drawings, and in particular to FIGS. 1 through 6 thereof, a new condiment device embodying the principles and concepts of an embodiment of the disclosure and generally designated by the reference numeral 10 will be described.

As best illustrated in FIGS. 1 through 6, the multiple condiment container assembly 10 generally comprises a container 12 has a bottom wall 14 and an outer wall 16 extending upwardly therefrom. The outer wall 16 has a distal edge 18 with respect to the bottom wall 14 defining an opening 20 into the container 12. Additionally, the outer wall 16 is continuously arcuate about a vertical axis of the container 12 such that the container 12 has a cylindrical shape. The outer wall 16 has an outer surface 22, and the outer surface 22 has a threaded portion 24 extending downwardly from the distal edge 18.

A plurality of dividers 26 is each positioned within the container 12 to define a plurality of chambers 28 within the container 12. Each of the chambers 28 may contain a respective one of a plurality of condiments 30. The condiments 30 may be fluid condiments such as ketchup and mustard, dry condiments such as salt and pepper or any other type of condiment for food. Each of the dividers 26 extends between the bottom wall 14 of the container 12 and the distal edge 18 of the container 12. Moreover, each of the dividers 26 is coupled to the outer wall 16 of the container 12 such that each of the chambers 28 is fluidly discrete from each other.

A lid 32 is removably coupled to the container 12 and the lid 32 has a plurality of openings 34 extending therethrough. Each of the openings 34 in the lid 32 is aligned with a respective one of the chambers 28 when the lid 32 is removably coupled to the container 12. The lid 32 has a top wall 36 and a perimeter wall 38 extending downwardly therefrom, and each of the openings 34 in the lid 32 extends through the top wall 36. Moreover, the perimeter wall 38 threadably engages the threaded portion 24 of the outer surface 22 of the outer wall 16 of the container 12.

A plurality of first panels 40 is provided and each of the first panels 40 is hingedly coupled to the lid 32. Each of the first panels 40 is aligned with a respective one of the openings 34 in the lid 32 and each of the first panels 40 has an aperture 42 extending therethrough. The aperture 42 in each of the first panels 40 is in fluid communication with the respective opening 34 in the lid 32. In this way the aperture 42 in each of the first panels 40 dispense the condiment 30 contained in the chamber 28 into which the respective opening 34 extends.

Each of the first panels 40 has a front edge 44 and a back edge 46, and each of the first panels 40 tapers outwardly between the back 46 and front 44 edges. Thus, each of the first panels 40 has a trapezoidal shape. The back edge 46 of each of the first panels 40 is hingedly coupled to the top wall 36 of the lid 32 and the front edge 44 of each of the first panels 40 is aligned with the perimeter wall 38 of the lid 32. Moreover, the first panels 40 are arranged to radiate outwardly from a center point of the top wall 36 of the lid 32.

A plurality of second panels 48 is provided and each of the second panels 48 is hingedly coupled to a respective one of the first panels 40. Each of the second panels 48 closes the aperture 42 in the respective first panel 40 when the second panels 48 are closed. Thus, each of the second panels 48 retains the condiment 30 contained in the chamber 28 into which the respective opening 34 extends. Each of the second panels 48 has a rear edge 50 and a forward edge 52, and each of the second panels 48 tapers outwardly between the rear 50 and forward 52 edges. Thus, each of the second panels 48 has a trapezoidal shape.

Figure 5:
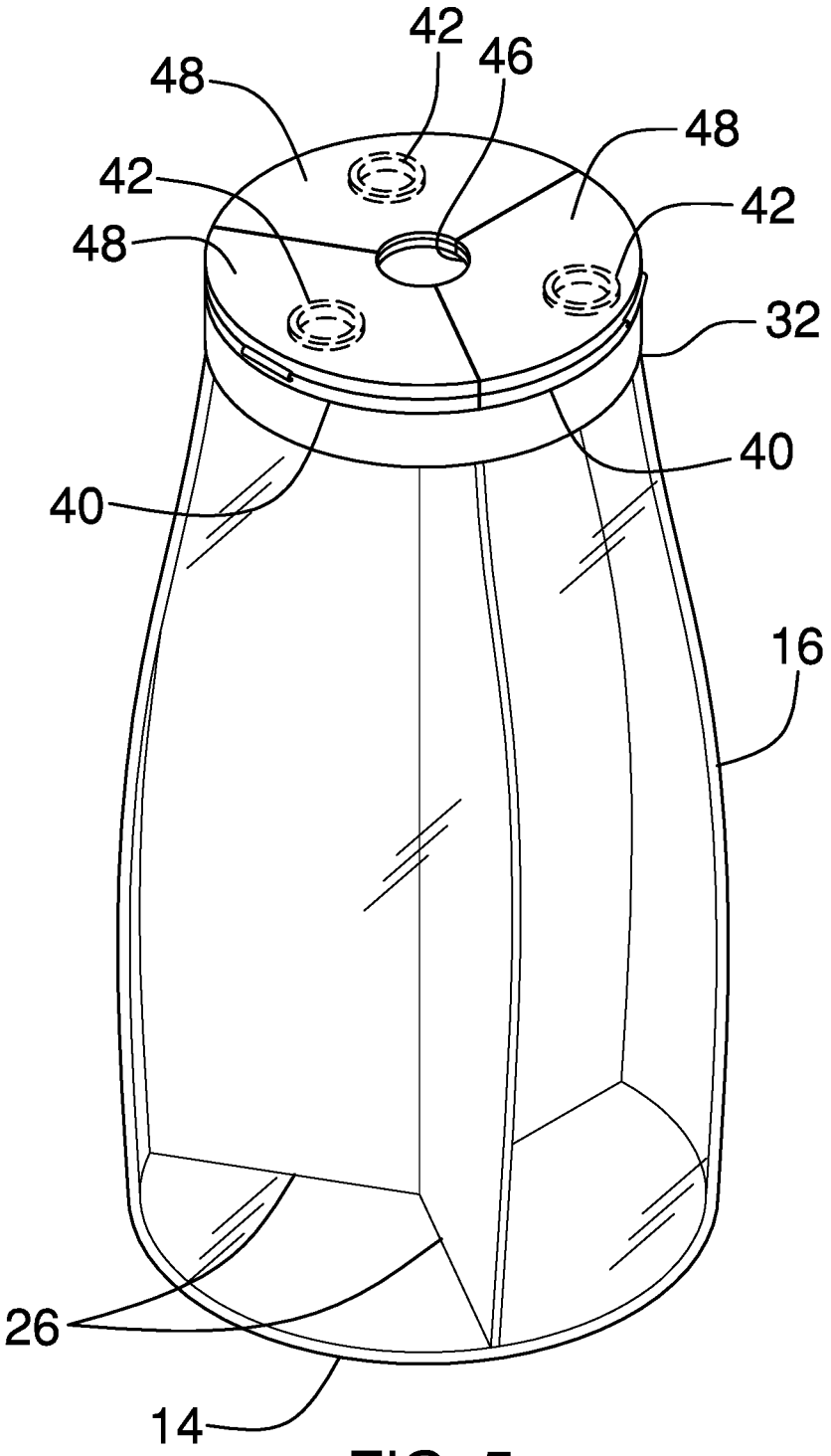
FIG. 5 is a perspective view of an embodiment of the disclosure showing three chambers.
Figure 6:
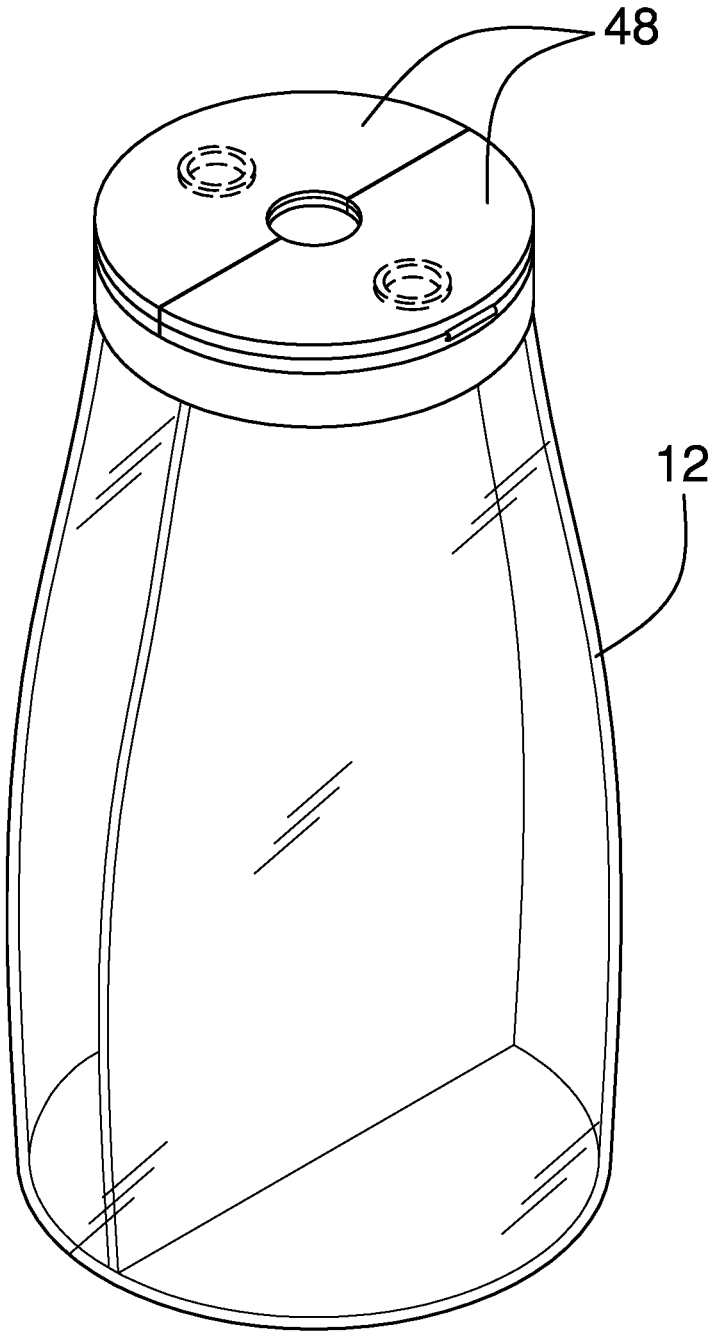
FIG. 6 is a perspective view of an embodiment of the disclosure showing two chambers.

The forward edge 52 of each of the second panels 48 is hingedly coupled to the front edge 44 of the respective first panel 40 and the forward edge 52 of each of the second panels 48 is aligned with the front edge 44 of the respective first panel 40. Moreover, each of the second panels 48 is positionable in an open position to dispense the condiment 30 contained in the chamber 28 into which the respective opening 34 extends. As shown in FIGS. 5 and 6, respectfully, the container 12 may have three chambers 28 or two chambers 28.

In use, the lid 32 is removed from the container 12 and the each of the chambers 28 is filled with the respective condiment 30. The lid 32 is positioned on the container 12 and each of the first 40 and second 48 panels is closed. The second panel 48 over a selected chamber 28 is opened for dispensing the condiment 30 contained in the selected chamber 28. In this way the condiment 30 in each of the chambers 28 can be individually dispensed. Each of the second panels 48 is closed to close the container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A multiple condiment container assembly being configured to contain and dispense a plurality of condiments, said assembly comprising:

a container;

a plurality of dividers, each of said dividers being positioned within said container to define a plurality of chambers within said container wherein each of said chambers is configured to contain a respective one of a plurality of condiments;

a lid being removably coupled to said container, said lid having a plurality of openings extending therethrough, each of said openings being aligned with a respective one of said chambers when said lid is removably coupled to said container;

a plurality of first panels, each of said first panels being hingedly coupled to said lid, each of said first panels being aligned with a respective one of said openings in said lid, each of said first panels having an aperture extending therethrough, said aperture in each of said first panels being in fluid communication with said respective opening in said lid wherein said aperture in each of said first panels is configured to dispense the condiment contained in said chamber into which said respective opening extends; and a plurality of second panels, each of said second panels being hingedly coupled to a respective one of said first panels, each of said second panels closing said aperture in said respective first panel wherein each of said second panels is configured to retain the condiment contained in said chamber into which said respective opening extends.

2. The assembly according to claim 1, wherein:

said container has a bottom wall and an outer wall extending upwardly therefrom, said outer wall having a distal edge with respect to said bottom wall defining an opening into said container, said outer wall being continuously arcuate about a vertical axis of said container such that said container has a cylindrical shape, said outer wall having an outer surface, said outer surface having a threaded portion extending downwardly from said distal edge; and each of said dividers extends between said bottom wall of said container and said distal edge of said container, each of said dividers being coupled to said outer wall of said container such that each of said chambers is fluidly discrete from each other.

3. The assembly according to claim 2, wherein said lid has a top wall and a perimeter wall extending downwardly therefrom, each of said openings in said lid extending through said top wall, said perimeter wall threadably engaging said threaded portion of said outer surface of said outer wall of said container.

4. The assembly according to claim 3, wherein each of said first panels has a front edge and a back edge, each of said first panels tapering outwardly between said back and front edges such that each of said first panels has a trapezoidal shape.

5. The assembly according to claim 4, wherein said back edge of each of said first panels is hingedly coupled to said top wall of said lid having said front edge of each of said first panels being aligned with said perimeter wall of said lid, said first panels being arranged to radiate outwardly from a center point of said top wall of said lid.

6. The assembly according to claim 4, wherein each of said second panels has a rear edge and a forward edge, each of said second panels tapering outwardly between said rear and forward edges such that each of said second panels has a trapezoidal shape.

7. The assembly according to claim 6, wherein said forward edge of each of said second panels is hingedly coupled to said front edge of said respective first panel having said forward edge of each of said second panels being aligned with said front edge of said respective first panel, each of said second panels being positionable in an open position wherein each of said second panels is configured to dispense the condiment contained in said chamber into which said respective opening extends.

8. A multiple condiment container assembly being configured to contain and dispense a plurality of condiments, said assembly comprising:

a container having a bottom wall and an outer wall extending upwardly therefrom, said outer wall having a distal edge with respect to said bottom wall defining an opening into said container, said outer wall being continuously arcuate about a vertical axis of said container such that said container has a cylindrical shape, said outer wall having an outer surface, said outer surface having a threaded portion extending downwardly from said distal edge;

a plurality of dividers, each of said dividers being positioned within said container to define a plurality of chambers within said container wherein each of said chambers is configured to contain a respective one of a plurality of condiments, each of said dividers extending between said bottom wall of said container and said distal edge of said container, each of said dividers being coupled to said outer wall of said container such that each of said chambers is fluidly discrete from each other;

a lid being removably coupled to said container, said lid having a plurality of openings extending therethrough, each of said openings being aligned with a respective one of said chambers when said lid is removably coupled to said container, said lid having a top wall and a perimeter wall extending downwardly therefrom, each of said openings in said lid extending through said top wall, said perimeter wall threadably engaging said threaded portion of said outer surface of said outer wall of said container;

a plurality of first panels, each of said first panels being hingedly coupled to said lid, each of said first panels being aligned with a respective one of said openings in said lid, each of said first panels having an aperture extending therethrough, said aperture in each of said first panels being in fluid communication with said respective opening in said lid wherein said aperture in each of said first panels is configured to dispense the condiment contained in said chamber into which said respective opening extends, each of said first panels having a front edge and a back edge, each of said first panels tapering outwardly between said back and front edges such that each of said first panels has a trapezoidal shape, said back edge of each of said first panels being hingedly coupled to said top wall of said lid having said front edge of each of said first panels being aligned with said perimeter wall of said lid, said first panels being arranged to radiate outwardly from a center point of said top wall of said lid; and a plurality of second panels, each of said second panels being hingedly coupled to a respective one of said first panels, each of said second panels closing said aperture in said respective first panel wherein each of said second panels is configured to retain the condiment contained in said chamber into which said respective opening extends, each of said second panels having a rear edge and a forward edge, each of said second panels tapering outwardly between said rear and forward edges such that each of said second panels has a trapezoidal shape, said forward edge of each of said second panels being hingedly coupled to said front edge of said respective first panel having said forward edge of each of said second panels being aligned with said front edge of said respective first panel, each of said second panels being positionable in an open position wherein each of said second panels is configured to dispense the condiment contained in said chamber into which said respective opening extends.

* * * * *